US009359841B2

(12) United States Patent
Hall

(10) Patent No.: US 9,359,841 B2
(45) Date of Patent: Jun. 7, 2016

(54) DOWNHOLE ROBOTS AND METHODS OF USING SAME

(75) Inventor: Lee J. Hall, Porter, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 910 days.

(21) Appl. No.: 13/356,234

(22) Filed: Jan. 23, 2012

(65) Prior Publication Data

US 2013/0186645 A1 Jul. 25, 2013

(51) Int. Cl.
*E21B 23/00* (2006.01)
*E21B 47/12* (2012.01)

(52) U.S. Cl.
CPC ..... *E21B 23/00* (2013.01); *E21B 47/12* (2013.01); *E21B 47/122* (2013.01); *E21B 2023/008* (2013.01)

(58) Field of Classification Search
CPC . E21B 2023/008; E21B 47/122; E21B 47/12; G01V 11/002
See application file for complete search history.

(56) References Cited

U.S. PATENT DOCUMENTS 5,392,715 A * 2/1995 Pelrine ..... 104/138.2
5,947,051 A * 9/1999 Geiger ..... 114/313
6,405,798 B1 * 6/2002 Barrett et al. ..... 166/250.01
6,799,633 B2 10/2004 McGregor
8,169,337 B2 * 5/2012 Evans et al. ..... 340/853.1
8,506,719 B2 * 8/2013 Holappa et al. ..... 134/6
2003/0234110 A1 * 12/2003 McGregor ..... 166/373
2004/0055746 A1 * 3/2004 Ross et al. ..... 166/250.15
2005/0024231 A1 2/2005 Fincher et al.
2005/0072577 A1 * 4/2005 Freeman ..... 166/386
2007/0029125 A1 * 2/2007 Jeswine et al. ..... 180/164
2009/0045975 A1 * 2/2009 Evans et al. ..... 340/855.5
2009/0078484 A1 * 3/2009 Kocijan ..... 180/167
2009/0166031 A1 7/2009 Hernandez
2009/0271117 A1 * 10/2009 Ayoub et al. ..... 702/11
2009/0301203 A1 * 12/2009 Brussieux ..... 73/627
2010/0242585 A1 * 9/2010 Pratyush et al. ..... 73/152.04
2010/0268470 A1 10/2010 Kamal et al.
2012/0048542 A1 * 3/2012 Jacob ..... 166/254.2
2013/0186645 A1 * 7/2013 Hall ..... 166/382
2014/0083688 A1 * 3/2014 Rojas et al. ..... 166/250.01

FOREIGN PATENT DOCUMENTS

FR 2861457 A1 4/2005

(Continued)

OTHER PUBLICATIONS

Foreign communication from a related counterpart application—Invitation to Pay Additional Fees, PCT/US2013/020553, Jan. 31, 2014, 5 pages.
Patent Search Report conducted by the Eurasian Patent Office regarding application Eurasian Patent Application 201491354, dated Mar. 11, 2015, 2 pages.

(Continued)

*Primary Examiner* — Jennifer H Gay
(74) *Attorney, Agent, or Firm* — Haynes and Boone, LLP

(57) ABSTRACT

A wellbore workstring. The workstring comprises a tubular string and a plurality of robots coupled to the tubular string. The robots establish a wireless communication network within a wellbore and deploy actuators to move themselves relative to the tubular string.

7 Claims, 6 Drawing Sheets

(56) References Cited

FOREIGN PATENT DOCUMENTS

| | | | | |
|---|---|---|---|---|
| GB | 2430018 | A | * | 3/2007 |
| RU | 2243372 | C1 | | 12/2004 |
| RU | 2424893 | C2 | | 7/2011 |
| WO | WO 2009050518 | A2 | | 4/2009 |
| WO | 2010105177 | A2 | | 9/2010 |
| WO | 2011019340 | A1 | | 2/2011 |
| WO | 2013112273 | A2 | | 8/2013 |

OTHER PUBLICATIONS

First Examiner's Letter prepared by the Canadian Intellectual Patent Office regarding Canadian Patent Application 2,861,648, dated Aug. 11, 2015, 5 pages.

Patent Examination Report conducted by the Australian Government Patent Office regarding Australian Patent Application 2013212696, dated Sep. 25, 2015, 4 pages.

* cited by examiner

DOWNHOLE ROBOTS AND METHODS OF USING SAME

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

A wellbore may be drilled to access and produce hydrocarbons. Alternatively or in addition, a wellbore may be drilled to receive and/or store fluids or gases, for example exhaust gases and/or greenhouse gases. During drilling operations, drilling fluid may be circulated to promote drilling operations. The drilling fluid may lubricate the engagement surfaces of a drill bit as it cuts in a subterranean formation. The drilling fluid may promote flowing drilling cuttings away from the drill bit and back to the surface where they can be separated from the circulating drilling fluid. The drilling fluid may promote maintaining a desirable hydrostatic pressure to prevent fluids from prematurely and/or uncontrollably entering the wellbore. The drilling fluid may promote maintaining the integrity of the walls of the wellbore. Different properties of the drilling fluid may be adapted to achieve one or more of these purposes and to accommodate various downhole conditions.

At different phases during the drilling of a wellbore casing may be run into the wellbore and cemented in place. A first casing string may be run in extending downwards to a first depth and cemented in place. Drilling may thereafter continue to drill beyond the first depth. A second casing string may be run in and hung off of the lower end of the first casing string, the second casing string extending downwards to a second depth, and cemented in place. Drilling may thereafter continue to drill beyond the second depth. Yet additional casing strings may be hung and cemented in the wellbore. The properties of the cement may be adapted to accommodate various downhole conditions.

When drilling the wellbore has been completed, the wellbore and/or casing may be perforated using a perforation gun. After perforation, the target formation or formations may be hydraulically fractured or serviced with different treatments, such as acidization treatment or other chemical treatment. The properties of the fracturing fluid and/or treatment fluids may be adapted to accommodate various downhole conditions.

SUMMARY

In an embodiment, a wellbore workstring is disclosed. The workstring comprises a tubular string and a plurality of robots coupled to the tubular string. The robots establish a wireless communication network within a wellbore and deploy actuators to move themselves relative to the tubular string. In an embodiment, the robots communicate wirelessly using radio frequency electromagnetic waves. In an embodiment, the robots communicate wirelessly using optical signals. In an embodiment, the robots communicate wirelessly using vibrations that the robots induce in the tubular string by impacting the tubular string with an actuator. In an embodiment, the robots comprise a magnet that couples the robots to the tubular string. In an embodiment, some of the robots are coupled to an outside surface of the tubular string. In an embodiment, some of the robots are coupled to an interior surface of the tubular string. In an embodiment, the robots comprise an actuator that displaces a body of the robot from the tubular string when the actuator is activated, thereby reducing the magnetic attraction between the magnet and the tubular string. In an embodiment, the robots slide along the tubular string when the actuator is activated, thereby moving relative to the tubular string.

In an embodiment, a method of deploying a workstring in a wellbore is disclosed. The method comprises introducing an initially unlinked robot into the interior of a tubular joint, coupling the tubular joint into a series of coupled tubular joints containing a plurality of robots to establish and extend the workstring, deploying the workstring into the wellbore, and establishing a wireless network by communicatively linking the initially unlinked robot with the plurality of robots. In an embodiment, the tubular joints are one of casing joints or drill pipe joints. In an embodiment, the method further comprises receiving data from the wireless network at the surface, wherein the data comprises information about conditions sensed by at least some of the robots downhole in the wellbore. In an embodiment, the method further comprises sending a command via the wireless network to the robots to reposition within the series of coupled tubular joints, wherein receiving data from the wireless network at the surface comprises receiving a plurality of sets of the data, each set of data associated with a different positional distribution of robots within the tubular.

In an embodiment, a method of servicing a wellbore is disclosed. The method comprises pumping a wellbore servicing fluid down a tubular located in the wellbore, wherein a plurality of robots coupled to the tubular have established a wireless communication network linked to the surface, receiving data from the wireless communication network at the surface, wherein the data comprises information about at least one property of the fluid sensed by at least one of the robots, and adapting the fluid at the surface based at least in part on the data received from the wireless communication network. In an embodiment, the wellbore servicing fluid is one of drilling fluid, cement, and fracturing fluid. In an embodiment, one of the robots comprises one of a pressure sensor, a temperature sensor, a viscosity sensor, a conductivity sensor, a magnetic permeability sensor, a flow rate sensor, or a density sensor. In an embodiment, the method further comprises transmitting a command to the robots to relocate themselves within the tubular, wherein the command is transmitted via the wireless communication network. In an embodiment, receiving data from the wireless communication network at the surface comprises receiving a plurality of sets of the data, each set of data associated with a different positional distribution of robots within the tubular and the method further comprises comparing different sets of data to determine a spatial distribution of downhole conditions. In an embodiment, the method further comprises at least one of the robots releasing a chemical. In an embodiment, the tubular is one of a string of pipe joints coupled together, a string of casing joints coupled together, and a coiled tubing.

In an embodiment, a downhole robot is disclosed. The downhole robot comprises a magnet and an actuator comprising a low friction engagement surface, wherein the actuator has a range of motion of less than a quarter inch, and wherein the actuator is configured to push the robot away from a tubular located in a wellbore when the actuator is activated to increase a distance between the magnet and the tubular and to promote motion of the robot by the low-friction engagement surface sliding over a surface of the tubular. The downhole robot further comprises a wireless communication transceiver. In an embodiment, the downhole robot further comprises a power source to harvest energy from the downhole environment and provide power to the actuator and the wireless communication transceiver. In an embodiment, the downhole robot further comprises a sensor, where the sensor is one of a pressure sensor, a temperature sensor, a density sensor, a conductivity sensor, or a flow rate sensor, wherein the wireless communication transceiver transmits data about a downhole condition sensed by the sensor. In an embodiment, the downhole robot further comprises a logical processor and a chamber that contains a chemical, wherein the logical processor is programmed to command release of the chemical from the chamber in response to a command received via the wireless communication transceiver. In an embodiment, the downhole robot further comprises a chamber that contains a chemical, wherein the chamber is configured to release the chemical in response to exposure to a downhole environment. In an embodiment, the low friction engagement surface comprises one of polytetrafluoroethylene (PTFE), graphitic carbon, or boron nitride.

These and other features will be more clearly understood from the following detailed description taken in conjunction with the accompanying drawings and claims.

BRIEF DESCRIPTION OF THE DRAWINGS

For a more complete understanding of the present disclosure, reference is now made to the following brief description, taken in connection with the accompanying drawings and detailed description, wherein like reference numerals represent like parts.

DETAILED DESCRIPTION

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

Unless otherwise specified, any use of any form of the terms "connect," "engage," "couple," "attach," or any other term describing an interaction between elements is not meant to limit the interaction to direct interaction between the elements and may also include indirect interaction between the elements described. In the following discussion and in the claims, the terms "including" and "comprising" are used in an open-ended fashion, and thus should be interpreted to mean "including, but not limited to . . . ". Reference to up or down will be made for purposes of description with "up," "upper," "upward," or "upstream" meaning toward the surface of the wellbore and with "down," "lower," "downward," or "downstream" meaning toward the terminal end of the well, regardless of the wellbore orientation. The term "zone" or "pay zone" as used herein refers to separate parts of the wellbore designated for treatment or production and may refer to an entire hydrocarbon formation or separate portions of a single formation such as horizontally and/or vertically spaced portions of the same formation. The various characteristics mentioned above, as well as other features and characteristics described in more detail below, will be readily apparent to those skilled in the art with the aid of this disclosure upon reading the following detailed description of the embodiments, and by referring to the accompanying drawings.

Figure 1:
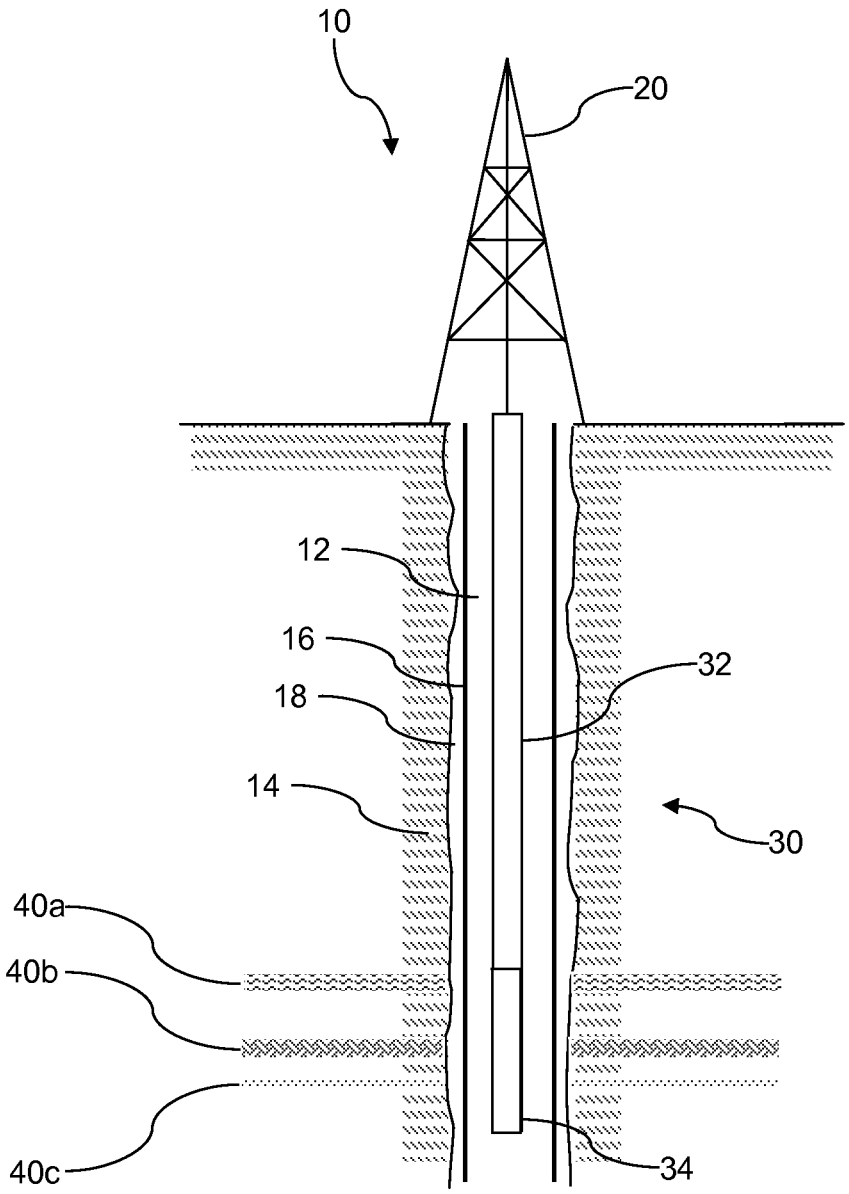
FIG. 1 illustrates a wellbore servicing system according to an embodiment of the disclosure.

Turning now to FIG. 1, a wellbore servicing system 10 is described. The system 10 comprises a servicing rig 20 that extends over and around a wellbore 12 that penetrates a subterranean formation 14 for the purpose of recovering hydrocarbons from a first production zone 40*a*, a second production zone 40*b*, and/or a third production zone 40*c*. The wellbore 12 may be drilled into the subterranean formation 14 using any suitable drilling technique. While shown as extending vertically from the surface in FIG. 1, in some embodiments the wellbore 12 may be deviated, horizontal, and/or curved over at least some portions of the wellbore 12. The wellbore 12 may be cased, open hole, contain tubing, and may generally comprise a hole in the ground having a variety of shapes and/or geometries as is known to those of skill in the art. In an embodiment, a casing 16 may be placed in the wellbore 12 and secured at least in part by cement 18.

The servicing rig 20 may be one of a drilling rig, a completion rig, a workover rig, or other mast structure and supports a workstring 30 in the wellbore 12, but in other embodiments a different structure may support the workstring 30. In an embodiment, the servicing rig 20 may comprise a derrick with a rig floor through which the workstring 30 extends downward from the servicing rig 20 into the wellbore 12. In some embodiments, such as in an off-shore location, the servicing rig 20 may be supported by piers extending downwards to a seabed. Alternatively, in some embodiments, the servicing rig 20 may be supported by columns sitting on hulls and/or pontoons that are ballasted below the water surface, which may be referred to as a semi-submersible platform or rig. In an off-shore location, the casing 16 may extend from the servicing rig 20 to exclude sea water and contain drilling fluid returns. It is understood that other mechanical mechanisms, not shown, may control the run-in and withdrawal of the workstring 30 in the wellbore 12, for example a draw works coupled to a hoisting apparatus, a slickline unit or a wireline unit including a winching apparatus, another servicing vehicle, a coiled tubing unit, and/or other apparatus.

In an embodiment, the workstring 30 may comprise a conveyance 32 and a downhole tool assembly 34. The downhole tool assembly 34 may be a drilling bit, a completion tool, a milling tool for cutting a hole in the casing 16 to begin drilling a lateral and/or deviated wellbore, a whipstock device, a packer, a logging tool, or other downhole tool. The conveyance 32 may be any of a string of jointed pipes, a slickline, a coiled tubing, and a wireline. The workstring 30 may comprise one or more packers, one or more completion components such as screens and/or production valves, sensing and/or measuring equipment, and other equipment which are not shown in FIG. 1. In some contexts, the workstring 30 may be referred to as a tool string. The workstring 30 may be lowered into the wellbore 12 to a bottom hole location, either in a main wellbore or in a lateral and/or deviated wellbore, to resume drilling operations. The workstring 30 may be lowered into the wellbore 12 to position the down hole tool assembly 34 to service one or more of the production zones 40. In various embodiments disclosed herein, the workstring 30 comprises a plurality of robots forming a communications network therebetween.

Figure 2:
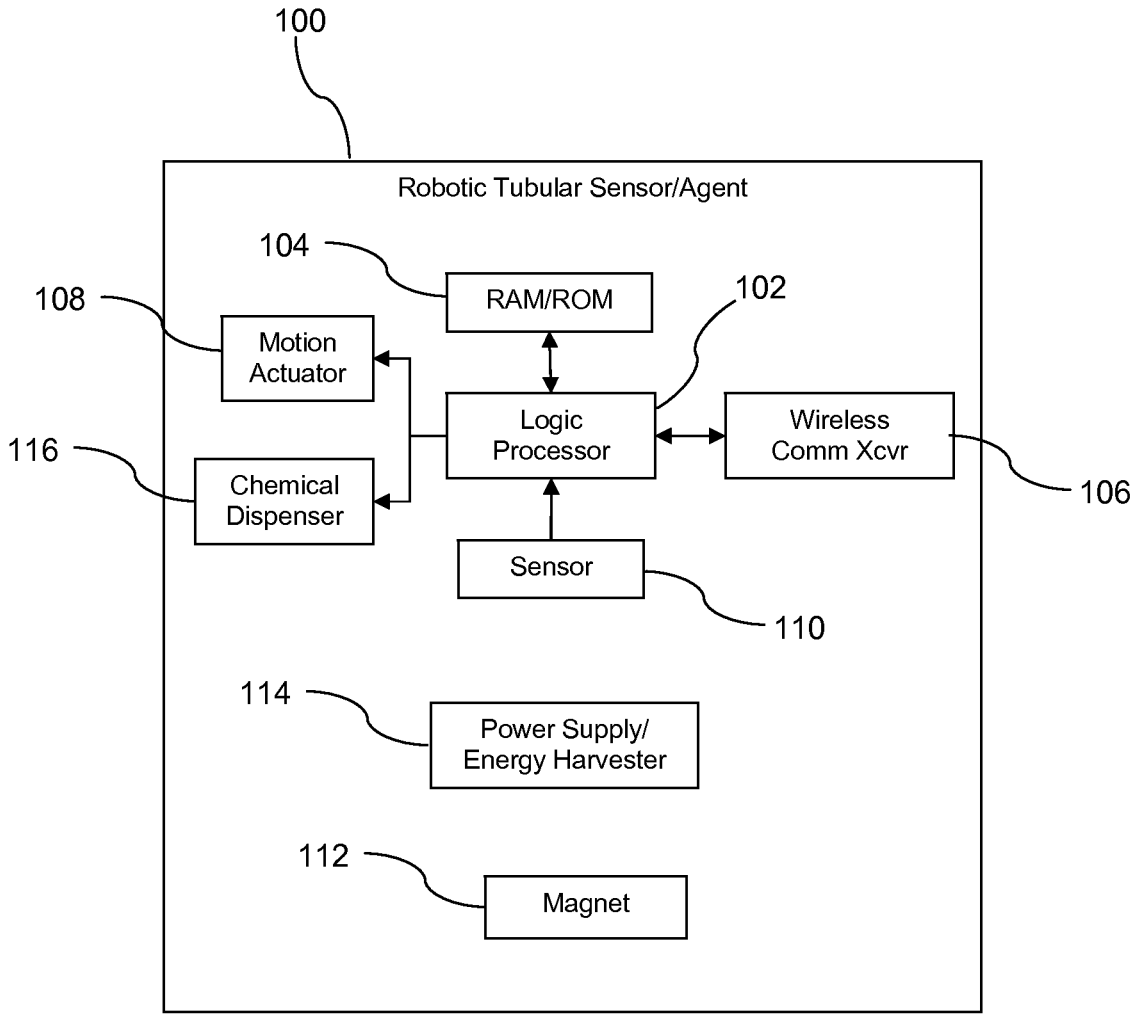
FIG. 2 is a block diagram of a downhole robot according to an embodiment of the disclosure.

Turning now to FIG. 2, a block diagram of a downhole robot 100 is described. In an embodiment, the downhole robot 100 comprises a logic processor 102, a memory 104, a wireless communication transceiver 106, a motion actuator 108, a sensor 110, a magnet 112, and a power supply 114. In an embodiment, the downhole robot 100 may further comprise a chemical dispenser 116. The downhole robot 100 shares some structures and components in common with computer systems. Computer systems are described further hereinafter. For example, the logic processor 102 may be substantially similar to the processor, and the memory 104 may be substantially similar to the read only memory (ROM) and/or random access memory (RAM) described hereinafter with reference to computer systems.

The wireless communication transceiver 106 may provide wireless communication links with other downhole robots 100 or with other devices. As used herein, the term wireless is intended to encompass a wide variety of wireless communication media. The wireless communication transceiver 106 may transmit and/or receive information modulated and/or encoded in radio frequency electromagnetic signals. The wireless communication transceiver 106 may transmit and/or receive information modulated and/or encoded in acoustic signals. For example, in an embodiment, the wireless communication transceiver 106 may comprise a piezoelectric component that is operable to impart an impulse or a ping to the workstring 30, and the workstring 30 may provide the acoustic medium for the encoded signal to propagate to the next downhole robot 100 or other acoustic receiver. The piezoelectric component may also be operable to receive acoustic signals conveyed by the workstring 30, for example an acoustic signal transmitted by another downhole robot 100. The wireless communication transceiver 106 may transmit and/or receive information modulated and/or encoded in optical signals. The wireless communication transceiver 106 may transmit and/or receive information by other wireless communication modes.

In an embodiment, the downhole robot 100 may comprise one or more sensors 110. In another embodiment, however, one or more of the downhole robots 100 may not comprise any sensor 110. The sensor 110 may comprise one or more of a temperature sensor, a pressure sensor, a conductivity sensor, a magnetic permeability sensor, an accelerometer, a microphone, a density sensor, a viscosity sensor, a pH sensor, a flow rate sensor, a gamma-ray detector, or other sensors. The viscosity sensor may be a rheometer. The accelerometer may be a 1-axis accelerometer, a 2-axis accelerometer, or a 3-axis accelerometer. The temperature sensor may be a thermocouple. The flow rate sensor may comprise a turbine or impeller component. The sensor 110 may provide a raw indication, for example a voltage or current that may be converted by processing by the logic processor 102 or by analysis on a computer at the surface. Alternatively, the sensor 110 may itself process the raw indication to convert it into a value representing an appropriate unit of measurement for the subject sensed parameter.

The power supply 114 may comprise a battery or other fuel supply for providing power for use by the several components of the down hole robot 100. The power supply 114 may comprise one or more devices for harvesting energy from the downhole environment. For example, the power supply 114 may comprise a micromechanical propeller turbine that turns in response to mud flow and thereby generates electrical power. The power supply 114 may comprise a piezoelectric component that generates electrical power in response to mechanical vibration. The power supply 114 may comprise an electroactive smart skin that harvests energy from turbulence incident on the electroactive smart skin.

The downhole robot 100 may couple to an interior or an exterior of the workstring 30 with magnetic force provided by the magnet 112. In an embodiment, the magnet 112 may be a permanent magnet. In an embodiment, the magnet 112 may be a neodymium magnet or other rare earth magnet. In an embodiment, the magnet 112 may be toroidal in shape (doughnut shaped), but in other embodiments the magnet 112 may assume a different geometry. In use, a plurality of downhole robots 100 may be securely held in desired position on the inside surface and/or on the outside surface of the workstring 30 by the magnets 112.

The downhole robots 100 may dynamically compose a wireless communication network by establishing wireless communication links with neighboring downhole robots 100, for example through a process of discovery and/or through a process of predefined identities. The downhole robots 100 may then propagate sensor information from the downhole environment uphole to the surface, for example to a controller station located at the surface. Alternatively, the downhole robots 100 may propagate command messages transmitted from the surface by a controller station downhole to downhole robots 100 configured to act as downhole agents to perform some desired action, for example to gather data, to release chemicals from the optional chemical dispenser 116, and/or to trigger activation of other downhole tools coupled to the workstring 30. The communications over the wireless communication network may employ the identities of the downhole robots 100 to flow up hole or down hole. For example, the downhole robots 100 may be numbered 1 for the first robot introduced into the borehole 12 (hence the robot furthest from the surface), numbered 2 for the second robot introduced into the borehole 12 (hence the robot next furthers from the surface), etc. Thus, passing a message from an (X)-th downhole robot 100 to an (X+1)-th downhole robot 100 corresponds to passing a message up hole; while passing a message from the (X)-th downhole robot 100 to an (X−1)-th downhole robot 100 corresponds to passing a message down hole, where X is some integer.

Alternatively, downhole robots 100 may be assigned arbitrary identities, for example an electronic serial number, a media access control (MAC) address, or some other identity. Each downhole robot 100 may be informed of the identities of proximate downhole robots 100 and whether the subject downhole robots are located above or below the downhole robot 100 in the workstring 30 when initialized and/or introduced into the wireless communication network, for example when initialized by a controller station at the surface.

Sensor data from the downhole robot 100 may be packaged in a data message along with the identity of the downhole robot 100 and sent to the surface via the wireless communication network. The data message may further comprise information about the location along the toolstring 30 of the downhole robot 100 originating the data message. Commands may be packaged in a command message along with the identity of the downhole robot 100 that is to respond to the command and sent down from the surface via the wireless communication network. Because the sensor data received at the surface, for example by a controller station, is associated with the identity of the source downhole robot 100 and because the location along the toolstring 30 can be known, the sensor data can be spatially resolved and/or associated with specific locations in the toolstring 30.

In an embodiment, the downhole robots 100 may be placed in the workstring 30 in desirable locations as the workstring 30 is composed and run into the wellbore 12. For example, as new joints of pipe are coupled into the workstring 30 during initial drilling of the wellbore 12 or as pipe is tripped back into the hole during a servicing operation such as drill bit replacement, a logging operation, or some other servicing operation. In an embodiment, downhole robots 100 may be placed into the interior or onto the exterior of joints of drill pipe as they repose on pipe racks on the well location. As the downhole robots 100 are introduced into the wellbore 12, each downhole robot 100 may be assigned an identity and/or an address that may be used for wireless communication among the downhole robots 100, for example by a controller station located at the surface.

In an embodiment, the downhole robots 100 may move themselves or self-locate themselves using one or more motion actuators 108. In an embodiment, the motion actuator 108 acts to displace the downhole robot 100—and hence the magnet 112—from the interior surface or exterior surface of the workstring 30. The motion actuator 108 may push the downhole robot 100 away from the surface of the workstring 30. When the magnet 112 is displaced from the surface of the workstring 30, the downhole robot 100 may slip over the surface of the workstring 30, for example in response to the force of gravity and/or in response to mud flow. The motion actuator 108 may have low friction surfaces where the motion actuator 108 contacts the surface of the workstring 30, and these low friction surfaces may promote the slipping motion of the downhole robot 100. In an embodiment, the motion actuator 108 may comprise a foot or contact surface coated with polytetrafluoroethylene (PTFE), coated with graphitic carbon, coated with boron nitride, or coated with another low friction material. It is expressly understood that graphitic carbon comprehends graphite, grapheme, and carbon nanotubes. The low friction surface is illustrated in FIG. 3 as described below. The contact surface may be referred to in some contexts as an engagement surface. In an embodiment, the motion actuator 108 moves the downhole robot 100 less than 1/10 inch off of the surface of the workstring 30. In an embodiment, the motion actuator 108 moves the downhole robot 100 less than 1/4 inch off of the surface of the workstring 30. In an embodiment, the motion actuator 108 moves the downhole robot 100 less than 1/2 inch off of the surface of the workstring 30. In another embodiment, the motion actuator 108 moves the downhole robot 100 at least 1/2 inch off of the surface of the workstring 30.

In an embodiment, the downhole robot 100 may comprise the chemical dispenser 116. The chemical dispenser 116 may comprise a chamber holding a chemical that may be released under control of the logic processor 102, for example when the wireless communication transceiver 106 receives a wireless message encoding a command to release the chemical. Alternatively, in an embodiment, the chemical may be retained within the chemical dispenser 116 at least in part by a thermoplastic or other material that melts or dissolves in the downhole environment, thereby releasing the chemical stored in the chemical dispenser 116. The release of the chemical from the chemical dispenser 116 upon triggering by a wireless message may be referred to as an active chemical release mechanism. The release of the chemical from the chemical dispenser 116 as a result of the downhole environment acting upon the chemical dispenser 116 may be referred to as a passive chemical release mechanism. The present disclosure contemplates including a chemical dispenser 116 that employs an active chemical release mechanism or a passive chemical release mechanism. A chemical dispenser 116 that employs a passive chemical release mechanism may be said to be configured to release the chemical in response to exposure to the downhole environment. The chemical may promote the swelling of an elastomer or other seal of a sealing tool such as a packer. The chemical may provide a cue detectable at the surface that is entrained in circulating fluid and hence indicates when fluid proximate to the subject downhole robot 100 has ascended an annulus of the wellbore 12 to the surface. The chemical may promote other operations.

In an embodiment, the downhole robot 100 does not require any specialized infrastructure in the workstring 30, and hence it is thought that the downhole robot 100 may be readily accepted for use in the standard oilfield environment. It is contemplated that the downhole robots 100 may be easily added to or removed from the workstring 30 during normal operations, such as tripping drill pipe into and/or out of the wellbore 12. It is contemplated that the downhole robots 100 may be prepositioned in drill pipe while stored in pipe racks on location. It is contemplated that the downhole robots 100 may be prepositioned in coiled tubing, for example before delivering the coiled tubing to the location. Additionally, it is thought that the downhole robot 100 may support significantly higher data throughput rates that those provided by the commonly deployed mud pulse modulation communication systems. The downhole robot 100 may be manufactured cheaply, thus loss of a few of the devices may not significantly impact wellbore servicing costs. Additionally, low cost of the downhole robots 100 may promote redundant deployment of downhole robots 100 which may promote increased communication bandwidth and/or enhanced reliability.

Figure 3A:
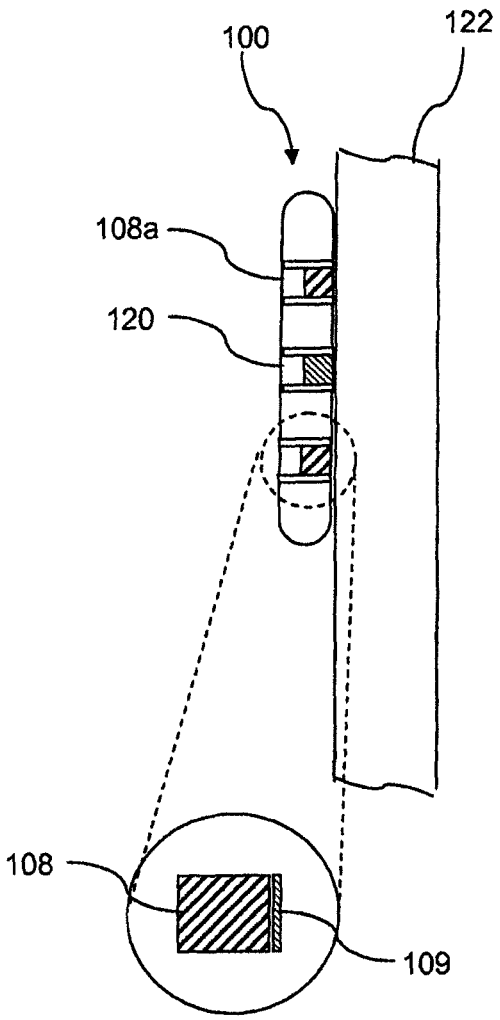
FIGS. 3A and 3B are respective side view illustrations of a downhole robot according to an embodiment of the disclosure.
Figure 3B:
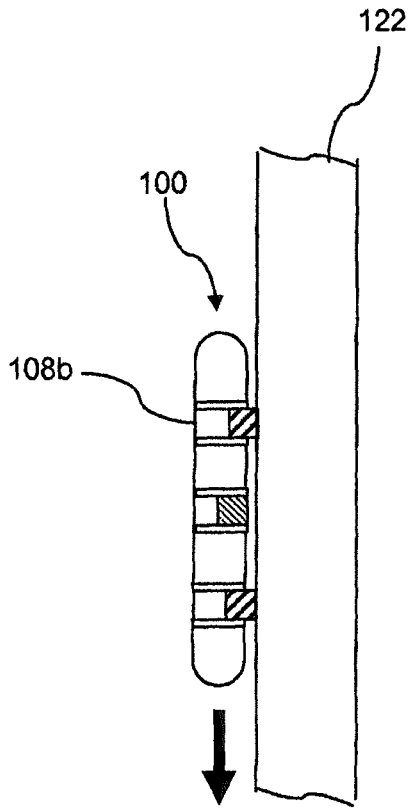

Turning now to FIGS. 3A and 3B, an illustration of the downhole robot 100 is seen in a side view. In an embodiment, the downhole robot 100 may comprise a piezoelectric actuator 120 that acts as an acoustic transceiver. The piezoelectric actuator 120 may provide the function of the wireless communication transceiver 106. The downhole robot 100 is shown on a surface 122 of the workstring 30—either an interior surface or an exterior surface. The motion actuator 108 is shown in an inactive state 108*a* in FIG. 3A and in an active state 108*b* in FIG. 3B. In FIG. 3A, the downhole robot 100 is shown coupled to the surface 122 in a stationary position. In FIG. 3B, the downhole robot 100 is shown lifted off of the surface 122 and in a slipping or sliding locomotion mode. The black arrow below the downhole robot 100 shown in FIG. 3B indicates the direction of motion of the downhole robot 100.

The motion actuator 108 may displace the downhole robot 100 a relatively small distance off of the surface 122. The small displacement, however, may remove high friction or moderate friction surfaces of the downhole robot 100 from contact with the surface 122 and instead place a low friction engagement surface 109 of the motion actuator 108 in contact with the surface 122, thereby encouraging the slipping and/or sliding of the downhole robot 100. The slipping and/or sliding of the downhole robot 100 when the motion actuator 108 is deployed may be promoted and/or motivated by the force of gravity and/or mud flow. To move, the downhole robot 100 may execute a series of slipping actions. For example, the motion actuator 108 may extend, the downhole robot 100 may slip, the motion actuator 108 may retract, the motion actuator 108 may extend, the downhole robot 100 may slip further, the motion actuator 108 may retract, and so on. The downhole robot 100 may incorporate a component that detects the amount of displacement of the downhole robot 100, for example an optical scanner that may be used to detect motion which can be processed by the logical processor 102 to estimate an amount of displacement. In an embodiment, the logical processor 102 may initiate a number of motion actuator 108 extend/retract cycles to accomplish a commanded amount of displacement.

In some modes of operation, the downhole robot 100 may move by slipping, re-stabilize by magnetic attachment to the surface 122, capture a sensed value of a downhole environmental parameter, transmit the sensed data uphole, and then repeat this cycle, thereby providing a sequence of sensed data values, each sensed data value associated with a different location along the workstring 30. Alternatively, the sequence of sensed data values may be stored in the memory 104 and transmitted up hole by the downhole robot 100 as a data message comprising multiple separate data values. Alternatively, the sequence of sensed data values may be stored in the memory 104 and recovered at the surface as the workstring 30 is removed from the wellbore 12. By taking a plurality of measurements, moving slightly between each measurement, the downhole robot 100 may provide more finely resolved spatial data. In some embodiments, the downhole robot 100 provides measurements while drilling (MWD).

Figure 4:
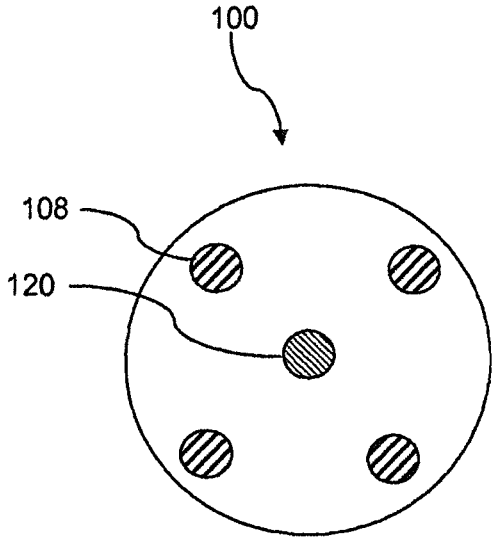
FIG. 4 is an illustration of a top view of a downhole robot according to an embodiment of the disclosure.

Turning now to FIG. 4, a top view of an embodiment of the downhole robot 100 is described. While illustrated in FIG. 4 with four motion actuators 108, the downhole robot 100 may comprise any number of motion actuators 108. While illustrated as substantially circular in shape, the downhole robot 100 may have other shapes. In an embodiment, the downhole robot 100 may be relatively small, for example less than 1 inch in diameter. In an embodiment, the downhole robot 100 may be less than 1/10 inch in diameter. In an embodiment, the downhole robot 100 may be less than 1/2 inch thick, less than 1/4 inch thick, or less than 1/10 inch thick. In another embodiment, however, the downhole robot 100 may have a different thickness. In an embodiment, the downhole robot 100 may comprise ports and/or channels to allow downhole fluids to pass through or enter the downhole robot 100 to promote sensing one or more parameter of the fluids. When the downhole robot 100 loses its attachment to the surface 122, the downhole robot 100 may be small enough to pass through apertures of a downhole tool, for example through drilling fluid jets of a drill bit, and out of the toolstring 30. In an embodiment, the downhole robot 100 may be circulated down the workstring 30 in drilling mud, flowed through the mud jets of a drill bit, and flowed up the outside of the workstring 30 where the downhole robot 100 may attach to the surface 122. Once attached to the surface 122, the downhole robot 100 may migrate its location to a desired position, for example establishing a desired distance between itself and its nearest neighboring downhole robots 100.

Figure 5:
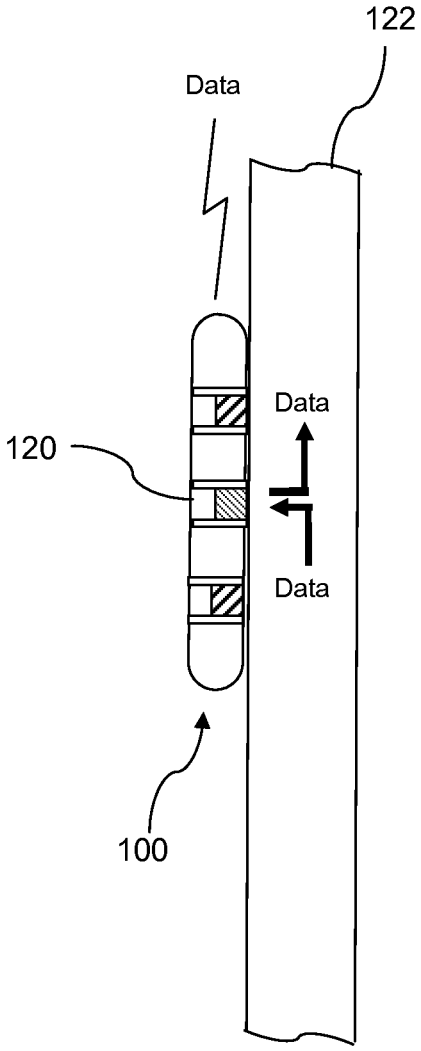
FIG. 5 is an illustration of a downhole robot transceiving data according to an embodiment of the disclosure.

Turning now to FIG. 5, the downhole robot 100 is shown in wireless communications. Data may be communicated as acoustic signals propagating in the surface 122 upwards to the downhole robot 100, and the piezoelectric actuator 120 may receive the acoustic signal. The logic processor 102 may analyze the acoustic signal and act on the information encoded in the acoustic signal and/or command the piezoelectric actuator 120 to relay the acoustic signal up the surface 122. Alternatively, a radio frequency electromagnetic (radio) signal may be received, analyzed, and/or relayed upwards. Alternatively, an optical signal may be received, analyzed, and/or relayed upwards.

Figure 6:
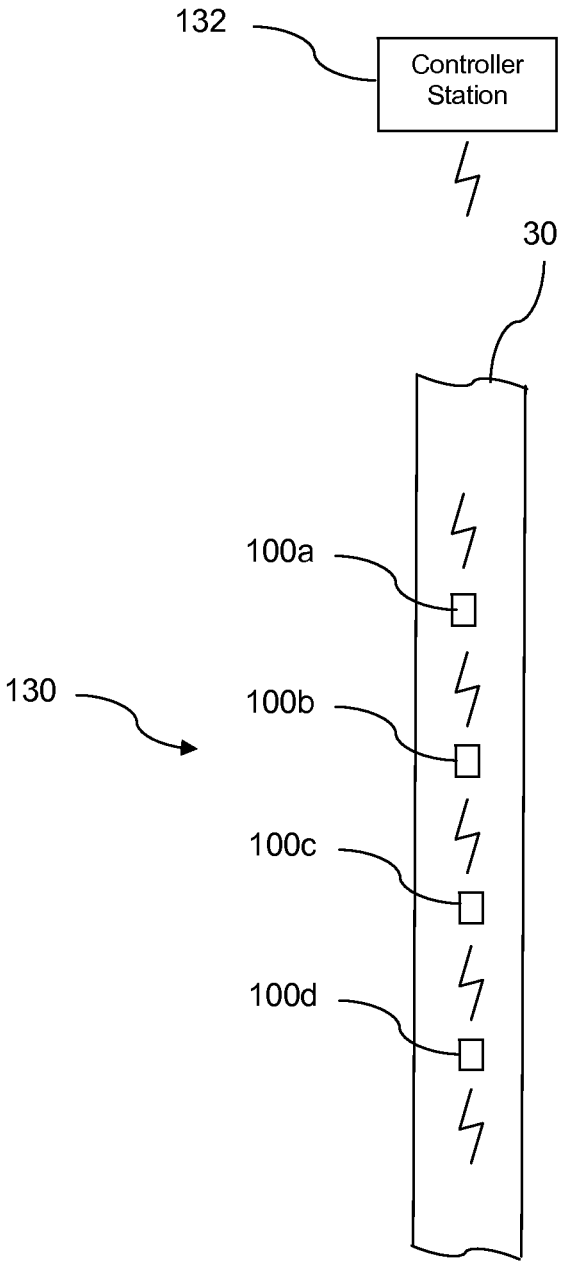
FIG. 6 is an illustration of a plurality of downhole robots forming a communication network in association with a tubular string according to an embodiment of the disclosure.

Turning now to FIG. 6, a plurality of downhole robots 100 are shown after they have formed a wireless communication network 130 on the surface of and/or inside of the workstring 30. For example, the wireless communication network 130 may comprise a first downhole robot 100*a*, a second downhole robot 100*b*, a third downhole robot 100*c*, and a fourth downhole robot 100*d*. The wireless communication network 130 may be established or extended as each additional downhole robot 100 is added to the workstring 30, for example as each new joint of drill pipe is coupled into the workstring 30, where an additional downhole robot 100 is associated with the new joint of drill pipe.

Initially, a single downhole robot 100 may be located in the workstring 30, and this first downhole robot 100 may establish wireless communication with a controller station 132 located at the surface. As another downhole robot 100 is added to the workstring 30, for example as a new joint of drill pipe containing an additional downhole robot 100 is coupled into the workstring 30, the additional downhole robot 100 may establish wireless communication with the controller station 132, and the controller station 132 may transmit a message to the additional downhole robot 100 identifying the structure of the communication network 130 or identifying for the additional downhole robot 100 its nearest downhole neighbor. For example, if a first downhole robot 100*d* is located below a second downhole robot 100*c*, when the second downhole robot 100*c* establishes wireless communication with the controller station 132, the controller station 132 may send a message to the second downhole robot 100*c* identifying the first downhole robot 100*d* as the nearest downhole neighbor of the second downhole robot 100*c*.

The second downhole robot 100*c* may send a message to the first downhole robot 100*d* informing that the nearest uphole neighbor of the first downhole robot 100*d* is no longer the controller station 132 but instead is now the second downhole robot 100*c*. In this way, the network 130 can be established and extended over time. Yet other approaches to building and extending the network 130 are contemplated by the present disclosure. Further, it is contemplated that the network 130 may be established to promote redundancy, so that if one of the downhole robots 100 is destroyed or dislodged, the network 130 may remain in service and adapt itself, for example healing any breaks in the serial linkage among the downhole robots 100.

In an embodiment, any number of downhole robots 100 may be coupled to the workstring 30 to form the wireless communication network 130. The downhole robots 100 may locate themselves to achieve a physical spacing that promotes reliable communication up and down the workstring 30, for example from the surface to the end of the workstring 30, and from the end of the workstring 30 back to the surface. In an embodiment, some redundancy of communication paths may be provided by the wireless communication network to provide for uninterrupted wireless communication even when failure of some downhole robots 100 occurs and/or when some downhole robots 100 are dislodged from the workstring 30.

The downhole robots 100 may be programmed to communicate with adjacent downhole robots 100 based on pre-assigned identities—for example addresses or numerical identities that may be assigned by the controller station 132 at the surface. Alternatively, the downhole robots 100 may dynamically discover each other and learn who their nearest and/or proximate neighbor downhole robots 100 are.

The down hole robots 100 may sense a variety of conditions in the down hole environment and wirelessly transmit sensor information to the controller station 132 at the surface via the wireless communication network 130. The sensor information may provide up-to-date knowledge to the controller station 132 of spatially distributed downhole environmental conditions. For example, the propagation up the wireless communication network 130 may support a significantly higher data rate of transmission than mud pulse technologies and hence support a more up-to-date view of downhole conditions. The sensor information may provide an accurate picture of large parameter gradients—temperature gradients, pressure gradients—along the workstring 30.

The location mobility of the downhole robots 100 promotes the ability to command the downhole robots 100 to locate in specific ways to promote ad hoc sensor data requirements. For example, it may be that rather than sensor data from points equally distributed the entire length of the workstring 30, it may be desirable to focus the sensing capability of the downhole robots 100 on a one hundred foot length of the wellbore 12 where a narrow production zone is being sought, possibly to initiate a lateral wellbore into the subject narrow production zone. The down hole robots 100 may be commanded by the controller station 132 to relocate with a downhole robot 100 positioned at one foot intervals through the zone of interest and to then collect and store sensor data. The workstring 30 may then be withdrawn from the wellbore 12, and the downhole robots 100 in the zone of interest may then be interrogated to provide their more spatially resolved data by the controller station 132 at the surface.

Alternatively, the down hole robots 100 may be commanded by the controller station 132 to successively relocate, capture sensor data, transmit uphole the sensor data, and again relocate, whereby a spatially fine grained picture of downhole conditions may be determined by the controller station 132. The sensed data values of a plurality of downhole robots 100 at a first time prior to moving may be thought of as a first set of sensor data; the sensed data values of the downhole robots 100 at a second time after moving may be thought of as a second set of sensor data. By comparing different sets of sensor data corresponding to changed locations of downhole robots 100 relative to the workstring 30, the controller station 132 can derive a more fine grained spatial resolution of downhole environmental conditions.

The controller station 132 may be coupled to a system for adapting fluids for introducing into the workstring 30 and/or into the wellbore 12. For example, the controller station 132 may be coupled to a mud mixing system and may automatically adapt the mud introduced into the workstring 30 based on the data returned uphole from the downhole robots 100. The controller station 132 and/or a mud mixing system communicating with the controller station 132 may adjust the ratios and in-flow rates of water, chemicals, weighting agents, and other materials to adapt the viscosity, the density, the pH, and other properties of the drilling mud. In an embodiment, the controller station 132 may adjust the pump rate and pressure of mud pumps providing pressurized mud to the workstring 30. The controller station 132 and/or a cement mixing system communicating with the controller station 132 may adjust the ratios and in-flow rates of water, dry cement material, and chemical additives to adapt the properties of cement introduced into the wellbore 12. The controller station 132 and/or a fracturing system communicating with the controller station 132 may adjust the pressure, in-flow rate, and the composition of fracturing fluid introduced into the wellbore 12.

In an embodiment, the downhole robot 100 is associated with a method. The method may comprise introducing the downhole robot 100 into the interior and/or exterior of a tubular joint. The tubular joint may be a length of drill pipe, a length of casing, or some other tubular. The tubular joint may then be coupled into a series of coupled tubular joints, for example the workstring 30 described above or into a casing string, to extend the workstring 30 and/or casing string. The workstring 30 and/or casing string may include a plurality of robots. The workstring 30 can then be deployed into the wellbore 12, and a wireless communication network can be established and/or extended. The wireless communication network can then be employed as described further above.

In an embodiment, the downhole robot 100 may be associated with a method of servicing the wellbore 12. A wellbore servicing fluid may be pumped down a tubular located in the wellbore 12, for example down the workstring 30. The wellbore servicing fluid may be drilling mud, cement, fracturing fluid, chemical treatment, acid treatment, or other fluid. A plurality of downhole robots 100 are coupled to the tubular and have established a wireless communication network. Data is received from the wireless communication network at the surface, wherein the data comprises information about at least one parameter of the fluid sensed by at least one of the downhole robots 100. The data may provide a spatially resolved picture of the servicing fluid in the wellbore 12, for example a pressure gradient of the servicing fluid in the wellbore 12, a temperature gradient of the servicing fluid in the wellbore 12, a density gradient of the servicing fluid in the wellbore 12, or other parameter gradients. The method may include adapting the properties of the servicing fluid at the surface based at least in part on the data received from the wireless communication network. For example, the servicing fluid being introduced into the wellbore 12 via the workstring 30 may be made denser or less dense, may be made to contain more or less of a particular additive. The servicing fluid may be provided at greater or lesser pressure by pumps. The servicing fluid may be adapted in other ways. The data may be received by the controller station 132 from the wireless communication network 130 and used by an automated controller coupled to the controller station 132 to automatically adapt the servicing fluid. In an embodiment, the servicing method is drilling the wellbore 12 and the servicing fluid is a drilling fluid and/or drilling mud.

In an embodiment, a packer fluid may be introduced into an annular region between the workstring 30 and the wellbore 12 and/or the casing 16 above and/or below a packer that is incorporated into the workstring 30. In an embodiment, the packer fluid may be disposed between two or more packers in an annular region between the workstring 30 and the wellbore 12 and/or the casing 16. The packer fluid may be disposed above and/or below an isolated area isolated by one or more packers.

A packer fluid may be any of a variety of fluids and may provide any of a variety of functions. For example, the packer fluid may provide hydrostatic pressure to lower differential pressure across a sealing element of the packer. The packer fluid may lower differential pressure on the wellbore 12 and/or the casing 16 to reduce the risks of collapse. The packer fluid may be used to protect metals and/or elastomers in the casing 16 and/or the workstring 30 from corrosion. The downhole robots 100 may be used to monitor the packer fluid, for example to sense changes in pressure, temperature, or other parameters, and to transmit sensed information to the surface, for example to the control station 132. The downhole robots 100 may be used to detect and/or measure motion of the packer fluid, for example motion of the packer fluid along the length of the workstring 30. In an embodiment, detected differences in fluid motion, temperature, density, pressure, viscosity or other properties of the packer fluid may be indicative or predictive of downhole problems, for example leak-off and/or in-flow such that the packer fluid may be lost, contaminated, or otherwise comprised. Additionally, it may be possible for the downhole robots 100 or for specialized instances of the down hole robots 100 to identify and report corrosion of components down hole.

In an embodiment, the workstring 30 incorporating one or more packers may be run into the wellbore 12 and/or the casing 16 with a plurality of downhole robots 100 riding in on the workstring 30. The packer or a plurality of packers may be set in the casing 16, and the downhole robots 100 may perform their function, such as monitoring, reporting, and/or triggering downhole functions including possibly releasing a chemical as described above. One or more of the downhole robots 100 may sense information about parameters of the packer fluid and transmit this to the surface, for example to the controller station 132 at the surface. Responsive to analysis of information collected by the downhole robots 100, for example an analysis of changing values of parameters associated with the packer fluid, the packer and/or packers may be unset, the workstring 30 may be moved in the casing 16, and the packers may be reset, for example when an initial packer set has not achieved a tight seal or for example when a packer set has relaxed or lost tightness over the passage of time. Alternatively, responsive to the analysis of information collected by the downhole robots 100, the packer fluid may be circulated out of the wellbore 12 and replaced with a different and/or a refreshed slug of packer fluid. Alternatively, responsive to the analysis of information collected by the downhole robots 100, one or more downhole robots 100 may be commanded to release a chemical from the chemical dispenser 116 into the packer fluid, for example a chemical to augment or refresh corrosion inhibitors in the packer fluid.

Figure 7:
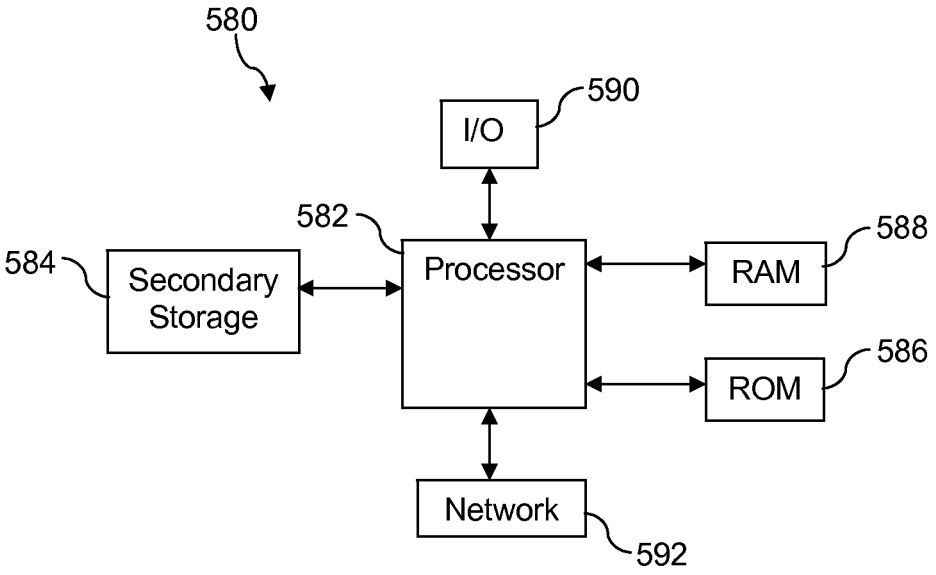
FIG. 7 is a block diagram of a computer system according to an embodiment of the disclosure.

FIG. 7 illustrates a computer system 380 suitable for implementing one or more embodiments disclosed herein. For example, the controller station 132 and/or a monitoring station for monitoring data transmitted by the downhole robots 100 and/or for transmitting commands to the downhole robots 100 may be implemented as a computer system 380. As a further example, an automated control system for adapting and/or controlling the properties of fluids pumped down the workstring 30 and/or the wellbore 12 based on data transmitted by the downhole robots 100 may be implemented as a computer system 380. The computer system 380 includes a processor 382 (which may be referred to as a central processor unit or CPU) that is in communication with memory devices including secondary storage 384, read only memory (ROM) 386, random access memory (RAM) 388, input/output (I/O) devices 390, and network connectivity devices 392. The processor 382 may be implemented as one or more CPU chips.

It is understood that by programming and/or loading executable instructions onto the computer system 380, at least one of the CPU 382, the RAM 388, and the ROM 386 are changed, transforming the computer system 380 in part into a particular machine or apparatus having the novel functionality taught by the present disclosure. It is fundamental to the electrical engineering and software engineering arts that functionality that can be implemented by loading executable software into a computer can be converted to a hardware implementation by well known design rules. Decisions between implementing a concept in software versus hardware typically hinge on considerations of stability of the design and numbers of units to be produced rather than any issues involved in translating from the software domain to the hardware domain. Generally, a design that is still subject to frequent change may be preferred to be implemented in software, because re-spinning a hardware implementation is more expensive than re-spinning a software design. Generally, a design that is stable that will be produced in large volume may be preferred to be implemented in hardware, for example in an application specific integrated circuit (ASIC), because for large production runs the hardware implementation may be less expensive than the software implementation. Often a design may be developed and tested in a software form and later transformed, by well known design rules, to an equivalent hardware implementation in an application specific integrated circuit that hardwires the instructions of the software. In the same manner as a machine controlled by a new ASIC is a particular machine or apparatus, likewise a computer that has been programmed and/or loaded with executable instructions may be viewed as a particular machine or apparatus.

The secondary storage 384 is typically comprised of one or more disk drives or tape drives and is used for non-volatile storage of data and as an over-flow data storage device if RAM 388 is not large enough to hold all working data. Secondary storage 384 may be used to store programs which are loaded into RAM 388 when such programs are selected for execution. The ROM 386 is used to store instructions and perhaps data which are read during program execution. ROM 386 is a non-volatile memory device which typically has a small memory capacity relative to the larger memory capacity of secondary storage 384. The RAM 388 is used to store volatile data and perhaps to store instructions. Access to both ROM 386 and RAM 388 is typically faster than to secondary storage 384. The secondary storage 384, the RAM 388, and/or the ROM 386 may be referred to in some contexts as computer readable storage media and/or non-transitory computer readable media.

I/O devices 390 may include printers, video monitors, liquid crystal displays (LCDs), touch screen displays, keyboards, keypads, switches, dials, mice, track balls, voice recognizers, card readers, paper tape readers, or other well-known input devices.

The network connectivity devices 392 may take the form of modems, modem banks, Ethernet cards, universal serial bus (USB) interface cards, serial interfaces, token ring cards, fiber distributed data interface (FDDI) cards, wireless local area network (WLAN) cards, radio transceiver cards such as code division multiple access (CDMA), global system for mobile communications (GSM), long-term evolution (LTE), worldwide interoperability for microwave access (WiMAX), and/or other air interface protocol radio transceiver cards, and other well-known network devices. These network connectivity devices 392 may enable the processor 382 to communicate with the Internet or one or more intranets. With such a network connection, it is contemplated that the processor 382 might receive information from the network, or might output information to the network in the course of performing the above-described method steps. Such information, which is often represented as a sequence of instructions to be executed using processor 382, may be received from and outputted to the network, for example, in the form of a computer data signal embodied in a carrier wave.

Such information, which may include data or instructions to be executed using processor 382 for example, may be received from and outputted to the network, for example, in the form of a computer data baseband signal or signal embodied in a carrier wave. The baseband signal or signal embedded in the carrier wave, or other types of signals currently used or hereafter developed, may be generated according to several methods well known to one skilled in the art. The baseband signal and/or signal embedded in the carrier wave may be referred to in some contexts as a transitory signal.

The processor 382 executes instructions, codes, computer programs, scripts which it accesses from hard disk, floppy disk, optical disk (these various disk based systems may all be considered secondary storage 384), ROM 386, RAM 388, or the network connectivity devices 392. While only one processor 382 is shown, multiple processors may be present. Thus, while instructions may be discussed as executed by a processor, the instructions may be executed simultaneously, serially, or otherwise executed by one or multiple processors. Instructions, codes, computer programs, scripts, and/or data that may be accessed from the secondary storage 384, for example, hard drives, floppy disks, optical disks, and/or other device, the ROM 386, and/or the RAM 388 may be referred to in some contexts as non-transitory instructions and/or non-transitory information.

In an embodiment, the computer system 380 may comprise two or more computers in communication with each other that collaborate to perform a task. For example, but not by way of limitation, an application may be partitioned in such a way as to permit concurrent and/or parallel processing of the instructions of the application. Alternatively, the data processed by the application may be partitioned in such a way as to permit concurrent and/or parallel processing of different portions of a data set by the two or more computers. In an embodiment, virtualization software may be employed by the computer system 380 to provide the functionality of a number of servers that is not directly bound to the number of computers in the computer system 380. For example, virtualization software may provide twenty virtual servers on four physical computers. In an embodiment, the functionality disclosed above may be provided by executing the application and/or applications in a cloud computing environment. Cloud computing may comprise providing computing services via a network connection using dynamically scalable computing resources. Cloud computing may be supported, at least in part, by virtualization software. A cloud computing environment may be established by an enterprise and/or may be hired on an as-needed basis from a third party provider. Some cloud computing environments may comprise cloud computing resources owned and operated by the enterprise as well as cloud computing resources hired and/or leased from a third party provider.

In an embodiment, some or all of the functionality disclosed above may be provided as a computer program product. The computer program product may comprise one or more computer readable storage medium having computer usable program code embodied therein to implement the functionality disclosed above. The computer program product may comprise data structures, executable instructions, and other computer usable program code. The computer program product may be embodied in removable computer storage media and/or non-removable computer storage media. The removable computer readable storage medium may comprise, without limitation, a paper tape, a magnetic tape, magnetic disk, an optical disk, a solid state memory chip, for example analog magnetic tape, compact disk read only memory (CD-ROM) disks, floppy disks, jump drives, digital cards, multimedia cards, and others. The computer program product may be suitable for loading, by the computer system 380, at least portions of the contents of the computer program product to the secondary storage 384, to the ROM 386, to the RAM 388, and/or to other non-volatile memory and volatile memory of the computer system 380. The processor 382 may process the executable instructions and/or data structures in part by directly accessing the computer program product, for example by reading from a CD-ROM disk inserted into a disk drive peripheral of the computer system 380. Alternatively, the processor 382 may process the executable instructions and/or data structures by remotely accessing the computer program product, for example by downloading the executable instructions and/or data structures from a remote server through the network connectivity devices 392. The computer program product may comprise instructions that promote the loading and/or copying of data, data structures, files, and/or executable instructions to the secondary storage 384, to the ROM 386, to the RAM 388, and/or to other non-volatile memory and volatile memory of the computer system 380.

In some contexts, the secondary storage 384, the ROM 386, and the RAM 388 may be referred to as a non-transitory computer readable medium or a computer readable storage media. A dynamic RAM embodiment of the RAM 388, likewise, may be referred to as a non-transitory computer readable medium in that while the dynamic RAM receives electrical power and is operated in accordance with its design, for example during a period of time during which the computer 380 is turned on and operational, the dynamic RAM stores information that is written to it. Similarly, the processor 382 may comprise an internal RAM, an internal ROM, a cache memory, and/or other internal non-transitory storage blocks, sections, or components that may be referred to in some contexts as non-transitory computer readable media or computer readable storage media.

While several embodiments have been provided in the present disclosure, it should be understood that the disclosed systems and methods may be embodied in many other specific forms without departing from the spirit or scope of the present disclosure. The present examples are to be considered as illustrative and not restrictive, and the intention is not to be limited to the details given herein. For example, the various elements or components may be combined or integrated in another system or certain features may be omitted or not implemented.

Also, techniques, systems, subsystems, and methods described and illustrated in the various embodiments as discrete or separate may be combined or integrated with other systems, modules, techniques, or methods without departing from the scope of the present disclosure. Other items shown or discussed as directly coupled or communicating with each other may be indirectly coupled or communicating through some interface, device, or intermediate component, whether electrically, mechanically, or otherwise. Other examples of changes, substitutions, and alterations are ascertainable by one skilled in the art and could be made without departing from the spirit and scope disclosed herein.

What is claimed is:

1. A wellbore workstring extending from a surface to a wellbore, the wellbore workstring comprising:

a tubular string; and a plurality of robots establishing a wireless communication network within the wellbore, each of the robots comprising a magnet that couples the robot to the tubular string and an actuator adapted to displace the magnet from the tubular string so that the magnetic attraction between the magnet and the tubular string is reduced, wherein, when the actuator displaces the magnet from the tubular string, the robot is in contact with the tubular string via at least a contact surface of the actuator;

wherein the plurality of robots establish the wireless communication network by establishing wireless communication links with neighboring ones of the plurality of robots within the wellbore; and wherein the plurality of robots are operable to propagate a wireless signal to the surface or, conversely, to receive a wireless signal from the surface, via the wireless communication network.

2. The wellbore workstring of claim 1, wherein the robots communicate wirelessly with one another using radio frequency electromagnetic waves.

3. The wellbore workstring of claim 1, wherein the robots communicate wirelessly with one another using optical signals.

4. The wellbore workstring of claim 1, wherein the robots communicate wirelessly with one another using vibrations that the robots induce in the tubular string by impacting the tubular string with the actuator.

5. The wellbore workstring of claim 1, wherein some of the robots are coupled to an outside surface of the tubular string.

6. The wellbore workstring of claim 1, wherein some of the robots are coupled to an interior surface of the tubular string.

7. The wellbore workstring of claim 1, wherein the robots are permitted to slide along the tubular string when the actuator displaces the magnet from the tubular string.

* * * * *